United States Patent [19]

Tietjens

[11] 3,962,784

[45] June 15, 1976

[54] DRY-SHAVING APPARATUS

[75] Inventor: Eduard Willem Tietjens, Drachten, Netherlands

[73] Assignee: U.S. Philips Corporation, New York, N.Y.

[22] Filed: Mar. 20, 1975

[21] Appl. No.: 560,165

[30] Foreign Application Priority Data

Apr. 5, 1974 Netherlands ..... 7404657

[52] U.S. Cl. ..... 30/43.6; 30/346.51

[51] Int. Cl.[2] ..... B26B 19/14

[58] Field of Search ..... 30/34.2, 43.4, 43.5, 30/43.6, 50, 205, 206, 207, 240, 346.51

[56] References Cited

UNITED STATES PATENTS

| | | | |
|---|---|---|---|
| 2,221,394 | 11/1940 | Colman | 30/34.2 |
| 3,088,205 | 5/1963 | Ellis | 30/43 B |

*Primary Examiner*—Al Lawrence Smith
*Assistant Examiner*—Gary L. Smith
*Attorney, Agent, or Firm*—Frank R. Trifari; J. David Dainow

[57] ABSTRACT

An electric dry-shaving apparatus with cutters which, viewed in their direction of movement, are preceded by separate hair pulling members, which pull the hairs slightly up from the skin before these are shaved off.

12 Claims, 9 Drawing Figures

DRY-SHAVING APPARATUS

BACKGROUND OF THE INVENTION

The invention relates to a dry-shaving apparatus which comprises a housing, an electric drive motor in the housing, one or more stationary external cutting members which project from the housing and which are provided with hair entrance apertures there are a corresponding number of internal cutting members which are covered by the external cutting members and which co-operate therewith internally, comprising a multiplicity of shaving cutters with cutting edges, and a corresponding number of drive studs which are coupled to the internal cutting members and are rotatable by the motor for driving the internal cutting members in a rotary fashion; also there are hair-pulling members associated with the shaving cutters, which are disposed at the front viewed in the direction of rotation of the cutters.

Shaving apparatus of this type are known from U.S. Pat. No. 3,088,205, wherein the cutters, viewed in the direction of movement, are either preceded by hair-pulling members which consist of thin flexible metal sheet, which are arranged parallel to the shaving cutters, or by hair-pulling members which engage with the shaving cutters, and take the form of strips of an elastic material such as a soft rubber. The hair pulling members are slightly shorter than the shaving cutters. The shaving cutters are in contact with the underside of the stationary shear plate with the side of their cutting edges, while the hair-pulling members only extend up to a short distance thereof and are consequently not in contact with the stationary cutter.

The U.S. Pat. No. 3,088,205 discloses one of the attempts to design a shaving apparatus which is capable of shaving off the face hairs not only down to skin level, but even down to a level below that of the skin. In order to achieve this the individual hairs to be shaved off must be slightly pulled up from the skin before being shaved off. After being shaved off, the hair is released and will retract into the skin owing to the natural elasticity of the tissue which surrounds the hair. By shaving off the hair at skin level at the instant that it is pulled up from the skin, it is achieved that after the hair has been shaved and has withdrawn into the skin said hair is located below the skin surface.

The shaving appliances known from the cited U.S. Patent aim at an action which, briefly summarized, amounts to the fact that the hair pulling member presses a hair which penetrates through the hair entrance aperture of the stationary cutter against the edge of the hair entrance aperture, folds it and pulls it slightly upwards from the skin owing to friction. If this construction is to have the required effect, the hairs to be cut must be comparatively long, flexible and also soft. However, investigstions have revealed that in practice these requirements are not met. The normal 1-day beard exhibits stubbles of a length which is only a few times, namely three to four times the hair thickness. Consequently, such stubbles are comparatively short and also stiff owing to their low length- diameter ratio. They are also comparatively hard, certainly from a dynamic point of view, i.e. in relation to the speed with which they are shaved off, so that as they are cut off they exert a substantial force component on the cutter in the direction perpendicular to the cutting plane. This force component tends to push the cutter away from the stationary shear plate and increases according as the hair is disposed more obliquely in the direction of movement of the cutter. Thus, sharply bent hairs tend to push the internal cutting member away from the external cutting member. Unless the internal cutting member is pressed against the external cutting member with a disproportionately great force, there will be play between the two cooperating cutting members. As a result, a reduced cutting action is obtained and the beard stubbles are cut off in a jagged manner, more or less in their longitudinal direction.

The situation is influenced by the wear of the internal cutting member. Owing to wear, the distance from the end of the hair pulling member to the inner side of the external cutting member changes. This distance may even be reduced to nil, so that the hair pulling member may also get into the hair entrance apertures of the external shaving member, especially when it consists of a soft rubber.

SUMMARY OF THE INVENTION

It is an object of the invention to provide a shaving apparatus of the type mentioned in the preamble, which is capable of cutting stubbles with properties as occur in practice down to a level which is below the skin level, the satisfactory performance not being affected by wear. The apparatus is characterized in that:

the front of the shaving cutter, viewed in the direction of rotation, forms an inclined face which encloses an acute cutting angle with the flat portion of the shaving cutter which cooperates with the stationary cutting member; the hair pulling member consists of a lead cutter with a cutting edge which has a cutting angle which at the most equals 90°, the lead cutter is slidable along said inclined face of the shaving cutter, the lead cutter in the direction of the stationary external cutting member, is resiliently loaded, and the lead cutter cooperates with the inner side of the stationary external cutting member.

The afore-mentioned steps, which must be taken in combination, aim at the following effect: at the instant that a lead cutter contacts a stubble, it will tend to cut off the stubble. The force which is exerted on the cutting edge of the lead cutter in its direction of movement will increase to such a value that the frictional forces between the lead cutter and the shaving cutter and the stubble and the edge of the hair entrance aperture are overcome, so that the lead cutter will slide along the inclined face of the associated shaving cutter. However, the friction between the cutting edge of the beard stubbles in such that the beard stubble is slightly pulled up from the skin, after which the shaving cutter reaches the stubble and cuts it off in the pulled-up position. Springing back to the stubble during this cutting process is prevented in that the lead cutter retains the stubble. Slipping of the cutting edge of the lead cutter past the stubble is also prevented in that the sharp cutting edge of the lead cutter slightly penetrates into the hair. Immediately after cutting off the remainder of the stubble springs back into the skin. Accurate observations with the aid of high-speed films have revealed that springing back takes a fraction of a millisecond (between 10 and 100 $\mu$secs.).

A study of the balance of forces of the lead cutter reveals that the invention, at least in accordance with the present views, is preferably characterized in that the cutting angle (Q) of the shaving cutter should comply with the relation:

$$\tan Q < \frac{1-\mu_1\mu_2}{\mu_1+\mu_2}$$

where

Q = cutting angle $u_1$ = angle of friction between the edge of the hair entrance aperture and the stubble $u_2$ = coefficient of friction between the lead cutter and the shaving cutter.

An embodiment which is aimed at practical realization of the invention, is characterized in that the lead cutters consist of thin, flexible strips having a width which substantially equals that of the shaving cutter, and the strips at their ends which are remote from their cutting edge are connected to the shaving cutter. In order to prevent painful sensations during shaving, in accordance with a further embodiment of the invention, the strip-shaped lead cutters have a maximum thickness of 0.15 cos. Q mm.

Simplification of manufacture and assembly is pursued by the following embodiment, which is characterized in that the strip-shaped lead cutters form part of a single component which is made of a thin sheet material and with their ends which are opposite their free ends are connected to a central part of said component, and the central part is secured to the associated internal cutting member.

The invention will be described in more detail with reference to the schematic drawing:

DETAILED DESCRIPTION OF THE PREFERRED EMBODIMENTS

Figure 1:
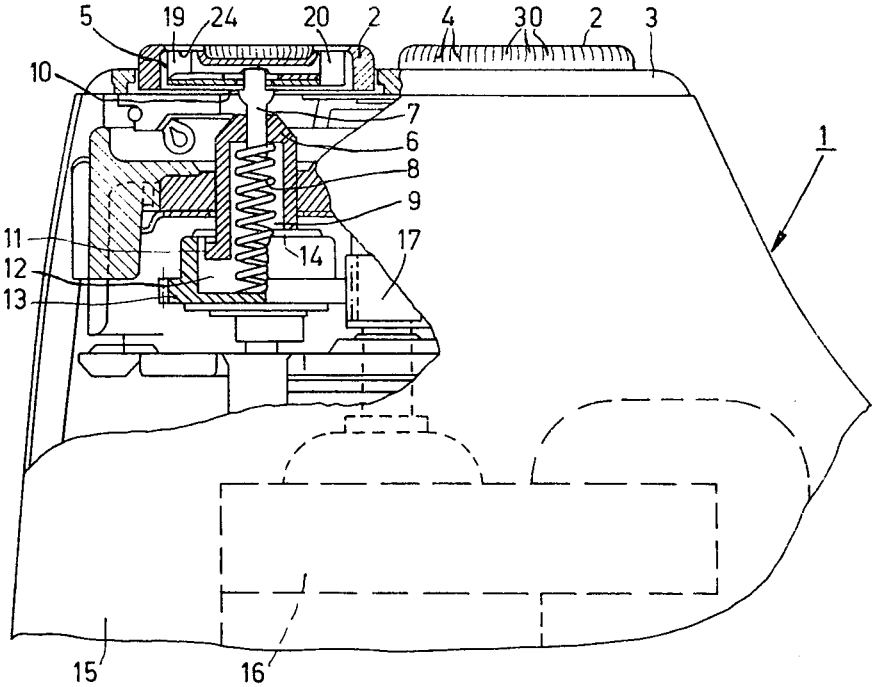
FIG. 1 shows a partially sectioned side elevation, of a dry-shaving apparatus with two external shaving members taking the form of shaving combs provided with hair-entrance apertures.

The dry-shaving apparatus 1, which is partly shown in FIG. 1, has two stationary external shaving members or shaving combs 2, which are pivotable to a limited extent in a mount 3. The combs 2 have a multiplicity of hair entrance apertures in the form of shaving slits 4 and co-operate with internal cutting members or cutters 5. These are rotatable by means of a drive stud 6 which is pivotable to a limited extent, and carries a coupling pin 7 at its end which faces the cutting member 5. The stud 6 is pressed against the cutting member 5 by the pressure spring 8, which is mounted in the recess 9. The cutting member 5 has a rectangular coupling slot 10, for this see in particular FIG. 2. The stud 6 is provided with a rectangular flange 11 at its lower end, which flange is mounted with play in a corresponding space 12 in a gear wheel 13. The space 11 is closed at its top by a resilient element 14.

In the plastics housing 15 of the dry-shaving apparatus, which housing consists of two sections, an electric drive motor 16 is mounted, by means of which the gear wheel 13 can be rotated via a pinion which is mounted on its shaft.

Figure 2:
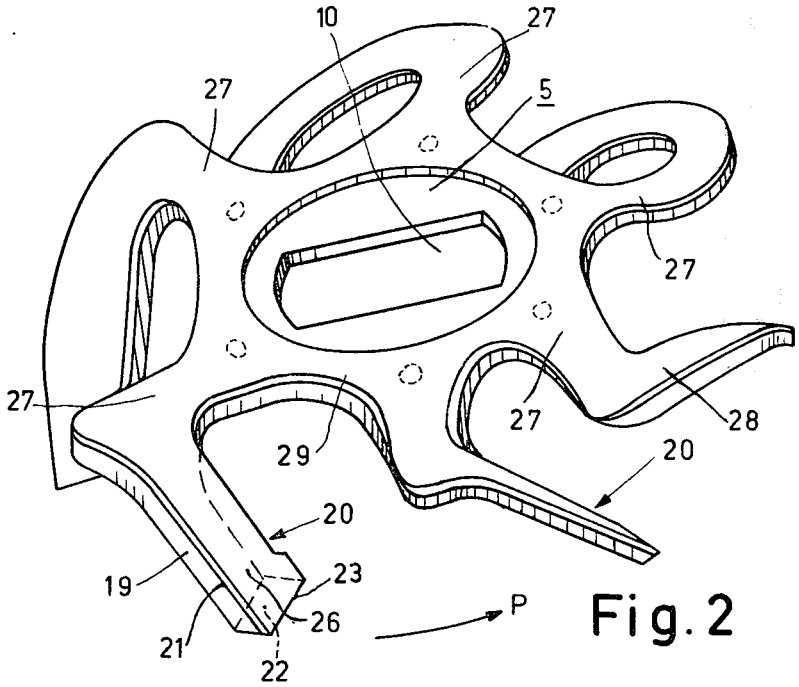
FIG. 2 is a greatly enlarged perspective view of the internal cutting member as employed in the shaving apparatus of claim 1, and on which a component made of a thin sheet material is mounted.
Figure 8:
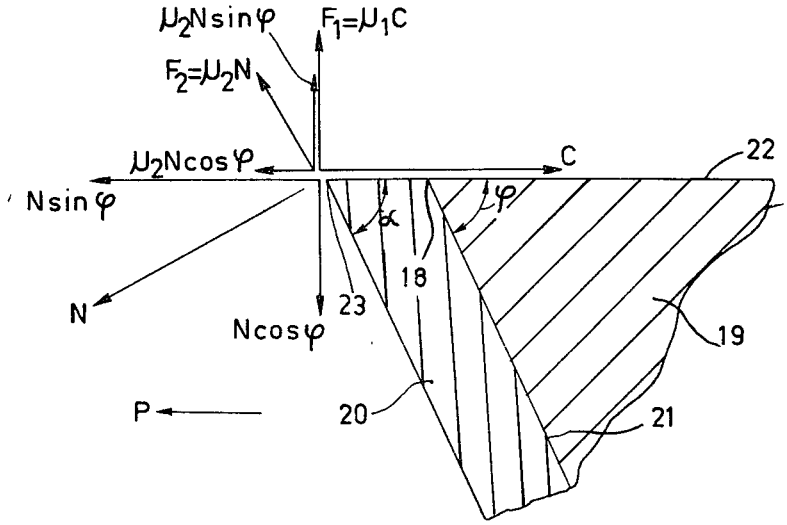
FIG. 8 is a schematic drawing and force diagram showing the theoretical background of the invention, showing an enlarged representation of a shaving cutter and its associated lead cutter.
Figure 9:
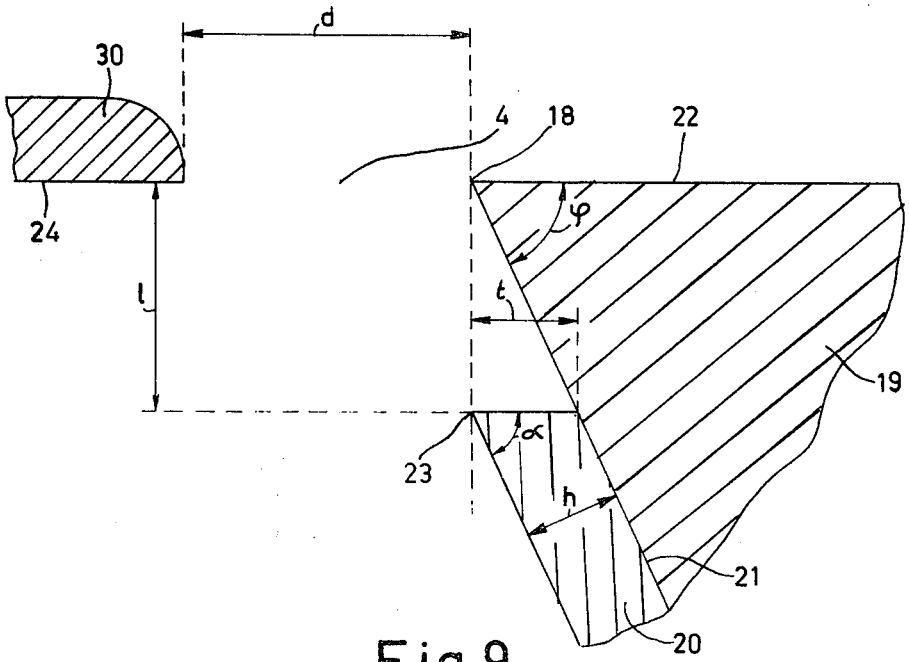
FIG. 9 again greatly enlarged shows a part of a shaving cutter and an associated lead cutter, but now in a shifted position relative to the shaving cutter, and furthermore a part of a lamella of a shaving comb as well as some angles and dimensions in explanation of the determination of the thickness of the lead cutter.

The front of the shaving cutter 19, as is particularly clear in FIGS. 2, 8 and 9, is provided with a sloping face 21 which encloses a sharp cutting angle Q with the flat part 22 which co-operates with the inner side 24 of the shaving comb 2. In FIG. 9 only a part of one of the lamellae 30 of the comb is visible, between which the shaving slits 4 of the shaving comb are disposed.

The hair pulling member or hair puller 20 consists of a lead cutter which comprises a cutting edge 23 having an angle $\alpha$ which at maximum equals 90°. In the Figures the cutting angle $\alpha$ of the lead cutter 20 always equals the cutting angle Q of the shaving cutter 19. However, this is not necessary; depending on the situation $\alpha$ may be selected greater or smaller. The lead cutter 20 is slidable along the sloping face 21 of the shaving cutter 19 and is resiliently loaded in the direction of the comb 2; furthermore, it co-operates with the inner side 24 of the comb in a similar way as the shaving cutter 19.

The lead cutters 20 consist of thin flexible strips 26 having a width which substantially equals that of the shaving cutters 19. At their ends 27 opposite the cutting edges 23 the strips 26 are connected to the shaving cutter 19. FIG. 2 shows an embodiment of one of an internal cutting member 5 provided with lead cutters 26. In this embodiment the strips 26 form part of a single component 28 which is made of a thin sheet material and they are connected to the central part 29 of said component with their ends 27 which are disposed opposite their free ends. The central part 29 is attached to the associated internal cutting member 5 for example by spot-welding or cementing. The lead cutters 20 are loaded in the direction of the shaving comb 2 by their own elasticity, when they move over the underside 24 of the comb 2 with their cutting edge 23. In the stationary condition the lead cutter engages with the underside 24 without pre-tension. Any initial pretension, if present, will be cancelled after a short time owing to wear of the free end of the lead cutter.

Figure 3:
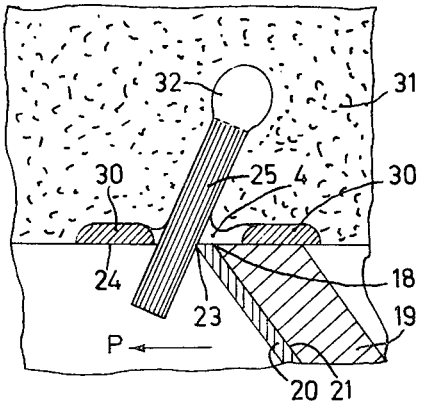
FIGS. 3–7, are schematic drawings showing the manner in which the shaving apparatus according to the invention functions during the cutting of a stubble.
Figure 4:
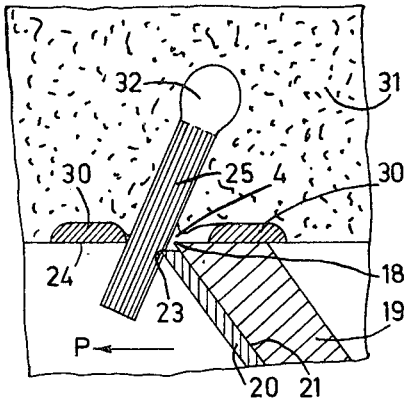
Figure 5:
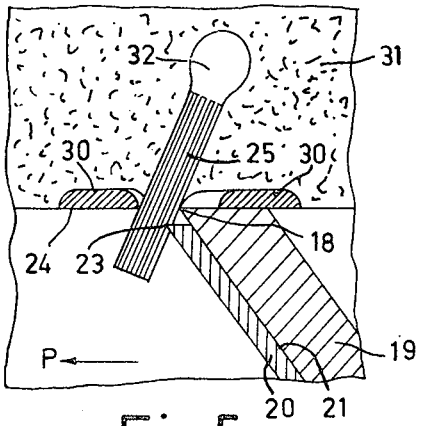
Figure 6:
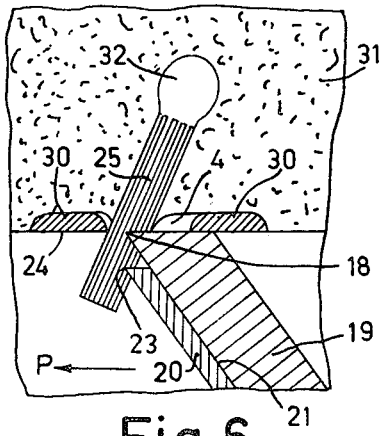
Figure 7:
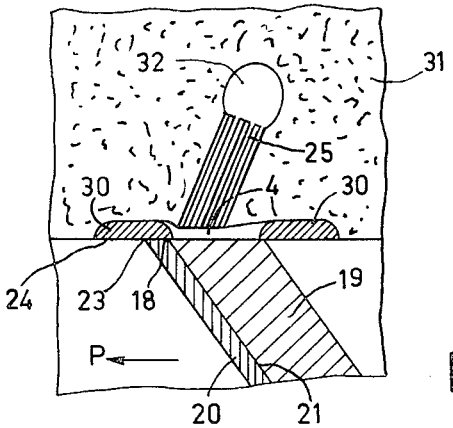

The operation of the invention will now be described with reference to FIGS. 3 through 7. In FIG. 3 two lamellae 30 of the shaving comb are shown; between them is a shaving slit 4 through which a stubble 25 protrudes. The stubble terminates in a follicle 32 in the skin 31 of a user of the shaving apparatus. FIG. 3 shows the situation in which the stubble is just pressed against the edge of the lamella 30 which is located in front of the shaving cutter viewed in the direction of movement P of the shaving cutter 19. The lead cutter 20 contacts the stubble 25 with its cutting edge 23. FIG. 4 shows the shaving cutter and the lead cutter slightly advanced in the direction of movement P. The cutting edge 23 of the lead cutter has slightly penetrated the hard external layer of the stubble 25. Owing to the continuous movement of the shaving cutter 19 the lead cutter 20 is slid over the sloping face 21 as a result of the force which acts on it. The friction between the cutting edges 23 and the stubble and the fact that the cutting edge has slightly penetrated the hard outer layer of the stubble, ensure that as the lead cutter 20 moves part the sloping face 21, the cutting edge 23 moving away from the underside of the lamellae 30, the stubble is slightly pulled up from the skin. In FIG. 5 the cutting edge 18 of the shaving cutter 19 has just reached the stubble and the stubble 25 has now been pulled out over a maximum length. In FIG. 6 the shaving cutter 19 has begun to cut off the stubble 25 with its cutting edge 18. An appropriate choice of the cutting angle Q of the shaving cutter 19 and the thickness of the lead cutter 20 ensures that the stubble 25 is not pulled up so far from the skin that the skin 31 itself is also drawn into the shaving slit 4. In FIG. 7 the stubble 25 is fully cut off, and owing to the natural elasticity of the surrounding tissue of the skin 31 it has withdrawn in the direction of the follicle 32. In this situation, as is clearly shown by the Figure, the stubble is cut off below skin level.

The theory underlying the hair pulling member according to the invention will be discussed in more detail with reference to FIG. 8. Due to the force with which the shaving cutter 19 is driven in the direction of movement P, a normal force N and a horizontal cutting force denoted by C will act on the cutting edge 23 of the lead cutter 20. The lead cutter is subject to frictional forces $F_1$ and $F_2$. The frictional force $F_1$ acts in the direction of the lamellae 30 of the comb and consequently tends to counteract the movement of the lead cutter 20 in the opposite direction. The frictional force $F_2$ acts between the lead cutter 20 and the shaving cutter 19 at the location of the sloping face 21 and tends to prevent sliding of these two cutters relative to each other.

The shown forces are balanced when:

$$C = N \sin Q + \mu_2 N \cos Q = N (\sin Q + \mu_2 \cos Q)$$

and furthermore $$N \cos Q = \mu_2 N \sin Q + \mu_1 C.$$

It readily follows from these two equations that $$\tan Q = \frac{1 - \mu_1 \mu_2}{\mu_1 + \mu_2}.$$

For a correct operation of the invention it is necessary that $$\tan Q < \frac{1 - \mu_1 \mu_2}{\mu_1 + \mu_2} \qquad \text{(I)}$$

In the equations:

C — is the cutting force which acts on the lead cutter 20,

N — the normal force which acts on the lead cutter 20,

Q — the cutting angle of the shaving cutter 19,

$\mu_1$ — a coefficient of friction which relates to the friction between a stubble and the edge of a hair entrance slit, $\mu_2$ — a coefficient of friction which relates to the friction between the shaving cutter 19 and the lead cutter 20.

The above derivation is based on a number of suppositions namely that:

1. the elastic force with which the stubble 25 is withdrawn is negligible,
2. the elastic force with which the lead cutter 20 is loaded in the direction of the underside 24 of the shaving comb 2 is negligible,
3. the lead cutter 20 slightly penetrates the hard outer layer of the stubble 25, so that the frictional force between the stubble and the lamella 30 (see FIGS. 3 – 7) is substantially smaller than the force which is exerted on the stubble by the lead cutter in its longitudinal direction.

Furthermore, dynamic effects have been completely disregarded in the derivation. These effects will demand a value of the angle Q which is definitely not greater than that dictated by the derived formula I.

Investigations have revealed that the length over which a stubble is pulled up from the skin during shaving, should probably not exceed the approximate hair thickness. For a specific choice of the cutting angle Q of the shaving cutter this yields a specific desired thickness $h$ of the lead cutter 20. It follows from FIG. 9 that:

$$\frac{l}{t} = \tan Q \text{ and } \frac{h}{t} = \sin\alpha = \sin Q,$$

so that:

$$h = l \cos Q,$$

and, as $l = h$:

$$h = d \cos Q.$$

Here, $0.1 \leq d \leq 0.15$, so that $h \leq 0.15 \cos Q$ (II)

In the above:

$d$ — is the diameter of a stubble in mm, $h$ — the thickness of the lead cutter 20,

$l$ — the length over which a stubble is pulled up from the skin, $t$ — the length of the flat portion with which the lead cutter 20 co-operates with the underside 24 of the shaving comb.

When it is assumed that $\mu_1 = 0.2$ and $\mu_2 = 0.5$, which are relatively conservative assumptions, it follows from (I):

$$Q < \text{arc tan } \frac{1 - 0.2 \times 0.5}{0.2 + 0.5} \qquad Q < 53°$$

and from (II):

$$h < 0.15 \cos 53° \Rightarrow h < 0.08 \text{ mm}.$$

Such a value for the thickness of the lead cutter 20 can be realized in practice without any problems.

The lead cutter 20 is preferably made of thin steel band. This not only simplifies manufacture, but it also implies that the cutting angle $\alpha$ should equal the cutting angle Q of the shaving cutter 19. However, this last requirement presents no problems.

It is evident that in such an embodiment wear of the face 22 of the shaving cutter 19 will not affect the satisfactory operation of the lead cutter 20. Said last-mentioned cutter will automatically be subject to the same degree of wear, without affecting the magnitude of the angle $\alpha$ or perceptibly affecting the elastic load of the lead cutter. Furthermore, the cutting edges 23 of the lead cutter and 18 of the shaving cutter will always remain sharp.

What is claimed is:

1. An electric dry-shaving apparatus which comprises:

a housing, an electric drive motor in the housing, at least one stationary member which projects from the housing and which has a plurality of spaced lamellae defining between each two lamellae a hair-entrance aperture, corresponding to each stationary cutting member an internal cutting member which is covered by the external cutting member and which co-operates therewith internally, each internal cutting member comprising a multiplicity of shaving cutters with cutting edges, a rotatable drive stud coupled to each internal cutting member and rotated by the motor for rotation of the internal cutting member, and a hair-pulling member which is associated with each shaving cutter, which when viewed in the direction of rotation of the shaving cutter, is disposed at the front side thereof, characterized in that the front of the shaving cutter, viewed in the direction of rotation, forms a sloping face which encloses an acute cutting angle (Q) with the flat part of the shaving cutter which co-operates with the stationary cutting member, the hair pulling member consists of a lead cutter, with a cutting edge which has a cutting angle which at the most equals 90°, the lead cutter is slidable past said sloping face of the shaving cutter, the lead cutter is resiliently loaded in the direction of the stationary external cutting member, and the lead cutter co-operates with the inner side of the stationary external cutting member.

2. An electric dry-shaving apparatus as claimed in claim 1, characterized in that the cutting angle (Q) of the shavingcutter complies with the relation:

$$\tan Q < \frac{1 - \mu_1\mu_2}{\mu_1 + \mu_2}$$

where:

Q = cutting angle $\mu_1$ = coefficient of friction between lamella and hair $\mu_2$ = coefficient of friction between lead cutter and shaving cutter.

3. An electric dry-shaving apparatus as claimed in claim 1, characterized in that the lead cutters comprise thin flexible strips having a width which substantially equals that of the shaving cutter and the strips at their ends opposed to their cutting edges are connected to the shaving cutter.

4. An electric dry-shaving apparatus as claimed in claim 3, characterized in that the strip-shaped lead cutters have a thickness which at maximum equals 0.15 cos Q mm.

5. An electric dry-shaving apparatus as claimed in claim 3, characterized in that:

the strip-shaped lead cutters form part of a single component made of a thin sheet material and with their ends which are disposed opposite their free ends are connected to a central portion of said component, and the central portion is secured to the associated internal cutting member.

6. In an electric shaver for cutting hairs and including a housing, an electric motor mounted in said housing, a comb carried by said housing, the comb having lamellae defining apertures between each two adjacent lamellae for receiving said hairs with an outer, exposed surface of said lamellae and an opposite inner surface of said lamellae, a cutter coupled to and driven by said motor in a predetermined direction, the cutter having blades extending therefrom with a top surface of each blade for engaging said inner surface of said comb lamellae, and means for resiliently urging said cutter blades against said inner surface of the lamellae, the improvement in combination therewith wherein said cutter-blade top surfaces define a plane generally parallel to said lamellae inner surface, each cutter blade has a lead surface in the direction of motion, and a cutting edge formed at the intersection of said top and lead surfaces, with an angle Q ≤ 90° defined between said top and lead surfaces, said improvement further comprising a hair puller secured to said cutter, with a hair puller blade adjacent each cutter blade, each hair puller blade having a top surface generally parallel to said cutter blade top surfaces, a lead surface in the direction of motion, and an opposite trailing surface in sliding engagement with said lead surface of the adjacent cutter blade, said hair pulled blade top surface being normally in said plane of said cutter blade top surface, and being movable in a direction away from said plane and being resiliently loaded in the direction toward said plane.

7. Apparatus according to claim 6, wherein said angle Q satisfies the relation:

$$\tan Q < \left[\frac{1 - \mu_1\mu_2}{\mu_1 + \mu_2}\right]$$

where $\mu_1$ = coefficient of friction between said hair and lamellae defining said hair-receiving apertures, and

$\mu_2$ = coefficient of friction between the lead surface of each cutter blade and the trailing surface of each hair puller blade.

8. In an electric shaver including a housing, an electric motor mounted in said housing and having a rotary output drive, a comb carried by said housing and having lamellae defining hair-receiving apertures between each two adjacent lamellae with an outer, exposed surface of said lamellae and an opposite inner surface of said lamellae, a rotary cutter coupled to and driven by said motor in a predetermined direction, the cutter having blades extending generally radially therefrom with the top surface of each blade for engaging said inner surface of said comb lamellae, and means for resiliently urging said cutter blades against said inner surfae of the lamellae, the improvement in combination therewith therein said cutter-blade top surfaces define a plane generally parallel to said lamellar inner surface, each cutter blade has a lead surface in the direction of motion, and a cutting edge formed as at the intersection of said top and lead surfaces, with an angle Q ≤ 90° defined between said top and lead surfaces, said improvement further comprising a hair puller secured to said cutter, with a hair puller blade adjacent each cutter blade, each hair puller blade having a top surface generally parallel to said cutter blade top surfaces, a lead surface in the direction of motion, and an opposite trailing surface in sliding engagement with said lead surface of the adjacent cutter blade, said hair puller blade top surface being normally in said plane of said cutter blade top surface, and being movable in a direction away from said plane and being resiliently loaded in the direction toward said plane.

9. Apparatus according to claim 8, wherein said cutter comprises a central part with said cutter blades extending therefrom, and wherein each hair puller blade comprises a thin flexible strip having one end adjacent said cutter lead edge and a remote end, and means securing said remote ends to said cutter central part.

10. Apparatus according to claim 9, wherein each hair puller blade has thickness, $L \leq 0.15 \cos Q$ (mm).

11. Apparatus according to claim 9, wherein said hair puller comprises a central part and said hair puller blades extending generally radially therefrom said hair puller central part and blades being a single, integral member of thin, flexible material.

12. Apparatus according to claim 8, wherein said hair puller comprises a circular central part defining a plane, outward said hair puller blades comprise teeth extending radially outwards from said central part and axially out of said plane.

* * * * *